US007967565B1

(12) United States Patent
Kimmel et al.

(10) Patent No.: US 7,967,565 B1
(45) Date of Patent: Jun. 28, 2011

(54) LOW COOLING FLOW TURBINE BLADE

(75) Inventors: Keith D Kimmel, Jupiter, FL (US); Jack W. Wilson, Jr., Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 95 days.

(21) Appl. No.: 12/408,023

(22) Filed: Mar. 20, 2009

(51) Int. Cl.
*F01D 5/14* (2006.01)
*F01D 5/18* (2006.01)
*F01D 5/28* (2006.01)

(52) U.S. Cl. ..... 416/96 A; 416/224; 416/232

(58) Field of Classification Search ..... 416/224, 416/232, 96 A
See application file for complete search history.

(56) References Cited

U.S. PATENT DOCUMENTS 3,378,228 A * 4/1968 Davics et al. ..... 416/95
3,767,385 A * 10/1973 Slaney ..... 420/585
3,846,041 A * 11/1974 Albani ..... 416/97 R
4,790,721 A * 12/1988 Morris et al. ..... 416/96 A
7,789,621 B2 * 9/2010 Dierksmeier et al. ..... 415/191
2006/0120869 A1 * 6/2006 Wilson et al. ..... 416/97 R
2008/0310965 A1 * 12/2008 Gerakis et al. ..... 416/97 R
2009/0202355 A1 * 8/2009 Dierksmeier et al. ..... 416/226
2010/0080687 A1 * 4/2010 Vance ..... 415/115

* cited by examiner

*Primary Examiner* — Edward Look
*Assistant Examiner* — Jesse Prager
(74) *Attorney, Agent, or Firm* — John Ryznic

(57) ABSTRACT

A turbine rotor blade made from a spar and a shell each having an airfoil cross sectional shape and each formed from a high temperature exotic material and formed by a wire EDM process to form a thin wall shell from Molybdenum and the spar from Waspalloy or IN100 in order to form a turbine blade that requires very low amounts of cooling air while allowing for high temperature use above what nickel super alloys can be exposed to. The spar and shell are secured to the platform by a bolt passing through the widest section of the hollow spar and connected at one end to a tip cap and to the other end to the platform and root piece of the blade.

17 Claims, 3 Drawing Sheets

LOW COOLING FLOW TURBINE BLADE

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with a very low cooling air flow requirement.

2. Description of the Related Art including Information Disclosed under 37 CFR 1.97 and 1.98

A gas turbine engine, such as an industrial gas turbine (IGT) engine, passes a hot gas flow through a turbine having a number of stages or rows of rotor blades and stator vanes to extract energy and drive the rotor shaft to produce electric power. It is well known that the efficiency of the engine can be increased by passing a higher temperature gas through the turbine. However, the maximum temperature is related to the material properties and the cooling capability of the first stages blades and vanes.

Prior art turbine airfoils are produced from high temperature resistant materials such as Inconnel and other nickel based super-alloys in which the airfoils are cast using the well known investment casting process. These materials have relatively high temperature resistance. However, a thin walled airfoil cannot be produced using the investment casting process because the airfoil wall is too thin for casting. A thin walled airfoil would be ideal for improved cooling capability since the heat transfer rate through the thin wall would be extremely high. In a thin walled airfoil, the outer airfoil surface temperature would be about the same as the inner airfoil wall temperature because of the high heat transfer rate.

Exotic high temperature resistant materials such as Tungsten, Molybdenum and Columbium have higher melting temperature than the nickel based super-alloys currently used in turbine airfoils. However, tungsten and molybdenum cannot be cast because of their high melting temperatures, and especially cannot be cast into a thin wall airfoil because the material cannot flow within the small space formed within the mold. Tungsten is a very dense metallic material and as such does not make for a good material for rotor blades because of the high centrifugal forces developed that adds high stress levels due to the high pulling force due to rotation.

Thus, a new and improved turbine blade has been proposed in which a high temperature resistant exotic material such as tungsten or molybdenum is used to form a thin walled shell for the airfoil that is secured to a spar that forms a rigid support structure for the shell. The shell is formed from tungsten or molybdenum using a wire EDM process to cut the metallic material into the shell shape. The shell in then secured to the spar to form a turbine blade or vane which can be used under much higher operating temperatures than the investment cast nickel super-alloy blade or vane.

BRIEF SUMMARY OF THE INVENTION

The above objectives and more are achieved with the spar and shell construction of the present invention in which the shell and the spar are both formed from a wire EDM process to produce a thin wall shell and to form the spar and shell from a high temperature exotic metallic material that cannot be cast from conventional metallic materials using the investment casting process or machined to a thin wall.

In one embodiment, a thin wall shell is formed from Molybdenum using a wire EDM process, and the spar is formed from Waspalloy or IN100 also using the wire EDM process, and both the spar and the shell are secured between a platform and a blade tip cap by a bolt that having a threaded end that screws into a threaded hole in the tip cap. The tip cap is also made from Molybdenum. With this turbine rotor blade having the high temperature exotic alloys, half the normal cooling air flow requirement is needed over the prior art turbine blades.

In another embodiment, the spar and shell are made from the same material and process as in the above embodiment, but the tip cap includes an extension that forms a threaded bolt that extends into a hole formed within the platform, and a threaded nut is used to secure the spar and shell between the tip cap and the platform. This turbine rotor blade also requires half the cooling air flow as does the prior art air cooled rotor blades.

In both embodiments, the tip cap includes a conical transition section from the tip cap to the bolt hole opening in order to distribute stress around the entire tip cap and to allow for the bolt to pass through the wider part of the airfoil shaped spar.

DETAILED DESCRIPTION OF THE INVENTION

The turbine rotor blade of the present invention is intended for use in an industrial gas turbine (IGT) engine, but could also be adapted for use in an aero engine. The turbine blade of the present invention is formed from exotic high temperature materials that require much less cooling air flow than the prior art air cooled turbine blades. Low cooling flow blades allow for much higher engine efficiencies due to less compressed air being bled off from the compressor. Thus, the compressor can also be made smaller and therefore of less weight.

Figure 1:
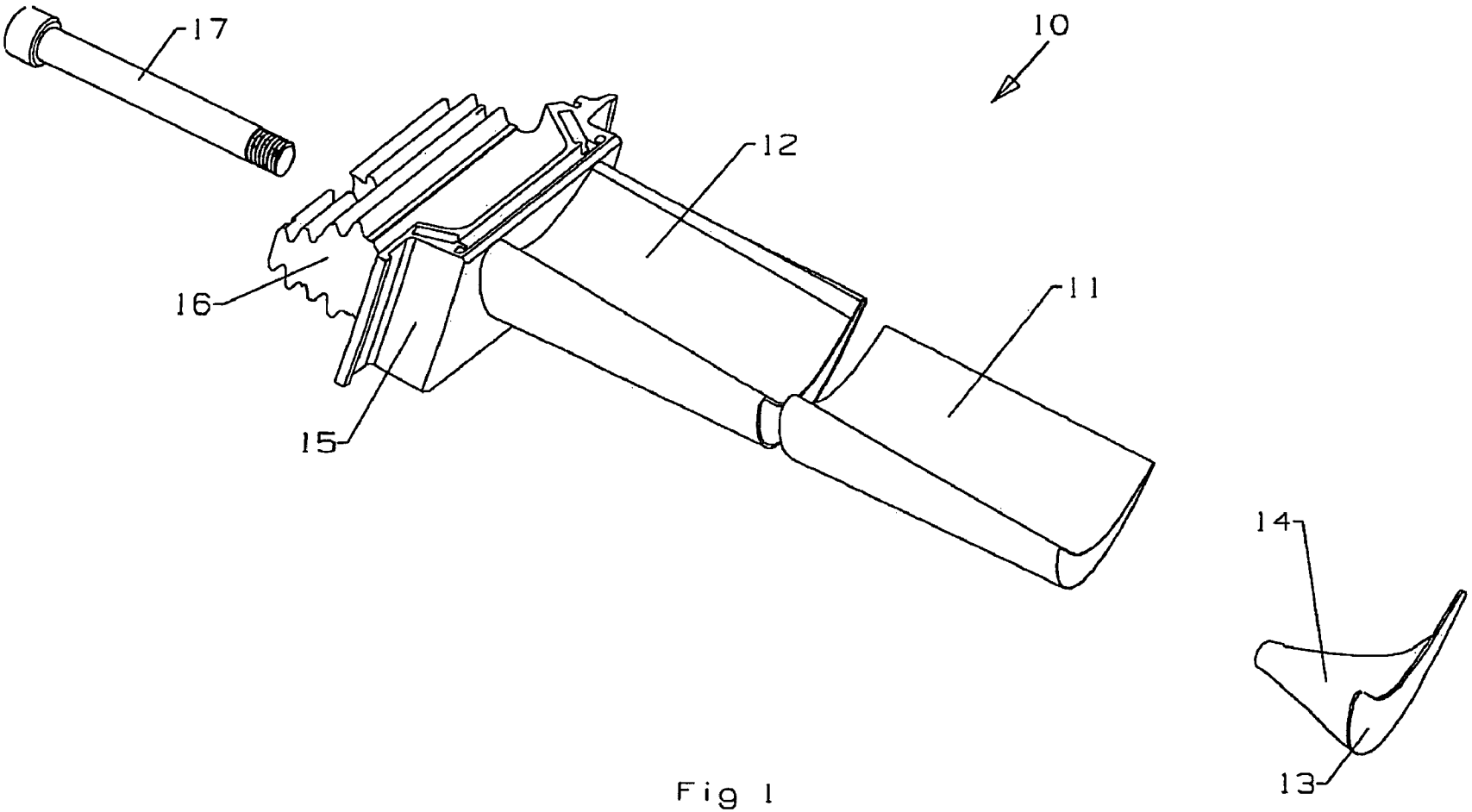
FIG. 1 shows a schematic view of a first embodiment of the turbine blade of the present invention.

FIG. 1 shows a schematic view of the turbine rotor blade of the present invention in which the blade 10 includes a shell that has an airfoil shape with a leading edge and a trailing edge, and a pressure side wall and a suction side wall extending between the two edges. The shell in this embodiment is formed from Molybdenum which is a high temperature exotic metallic material that cannot be cast into a thin wall (0.010 to 0.030 inches thick) in order to form a thin wall airfoil to produce near wall cooling. The Molybdenum shell 11 is formed using a wire EDM process which cuts the inner and outer surfaces of the shell. In other embodiments, the shell can be formed from a single crystal material or a directionally solidified material. However, Molybdenum has the right structural properties and high temperature strength to produce a turbine blade that will operate for long periods of time in an IGT engine.

The spar 12 is also formed using the wire EDM process, but is made from a different material such as Waspalloy or IN100 because the spar is exposed to a lower temperature than is the shell. However, the spar 12 can also be made form Molybdenum. The spar 12 is also a thin walled airfoil but not as thin as the shell is. Both the shell 11 and the spar 12 are held in place to form the blade assembly by a tip cap 13 that includes a conical shaped transition piece 14 for attaching to a blade platform 15 and root 16 piece. In this embodiment, the tip cap extension 14 includes a threaded hole in which a bolt 17 screws into to secure the pieces together to form the blade assembly 10. The bolt is made from MP159 which has a strength around 10 times greater than steel. When the rotor blade 10 is assembled, the root includes a fir tree configuration for insertion into a slot formed within a rotor disk.

Figure 2:
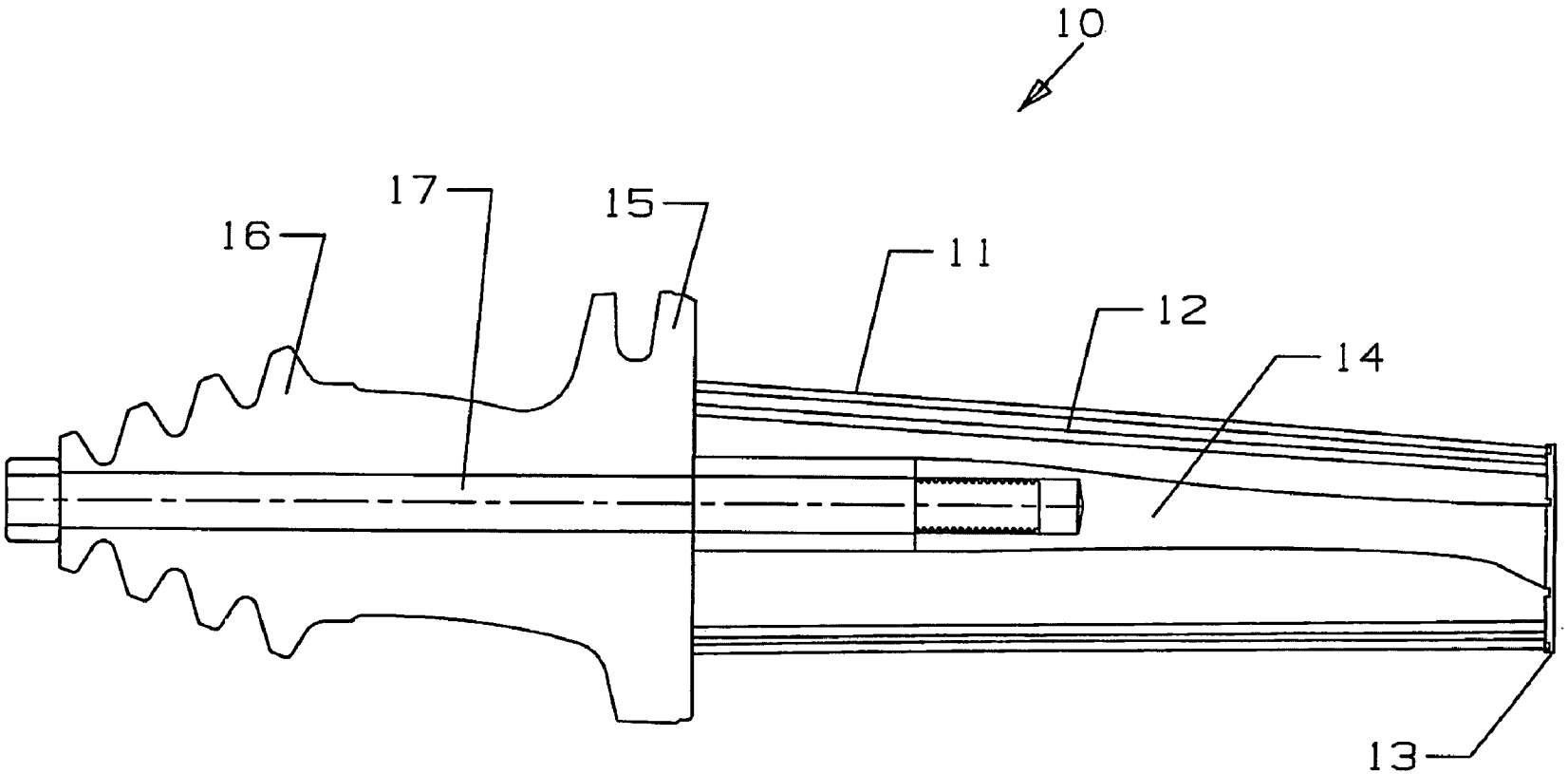
FIG. 2 shows a cross section view of the turbine blade of FIG. 1 in an assembled state.

FIG. 2 shows the rotor blade 10 in an assembled state with the shell 11 and spar 12 secured between the tip cap 13 and the platform 15 and root 16 piece by the bolt 17 that threads into a hole of the tip cap extension 14. In this embodiment, a series of serpentine flow cooling channels are formed between the shell and the spar to provide near wall cooling for the shell. The cooling air is supplied through one or more channels formed within the root 16 and is discharged out through a row of trailing edge cooling holes that can be formed within the shell by an EDM process. Because the shell is thin, the metal temperature is kept much lower because of a high heat transfer rate from the outer surface to the inner surface. A relatively thick airfoil wall, such as that found in the investment cast turbine blades, does not have the high heat transfer rate found in the shell of the present invention and thus the metal temperature of the airfoil is higher. This would require much more cooling air to keep the prior art airfoil within an acceptable level to prevent thermal damage. Also, since the turbine blade 10 of the present invention does not require film cooling holes on specific sections of the outer airfoil surface, all of the cooling air can be used to cool the inner wall of the shell. This also requires less cooling air flow than the prior art turbine blades. If required, film cooling holes could be provided in the shell in the leading edge region to form a showerhead arrangement of film holes.

The tip cap conical shaped extension is shaped so that the loading force from the bolt or nut being tightened is spread out over as much of the tip cap that abut against the shell upper end as possible. Also, the widest interior portion of the hollow spar is in the leading edge region and this is where the bolt or the bolt extension in the second embodiment will fit in order to secure the spar and shell to the platform.

Figure 3:
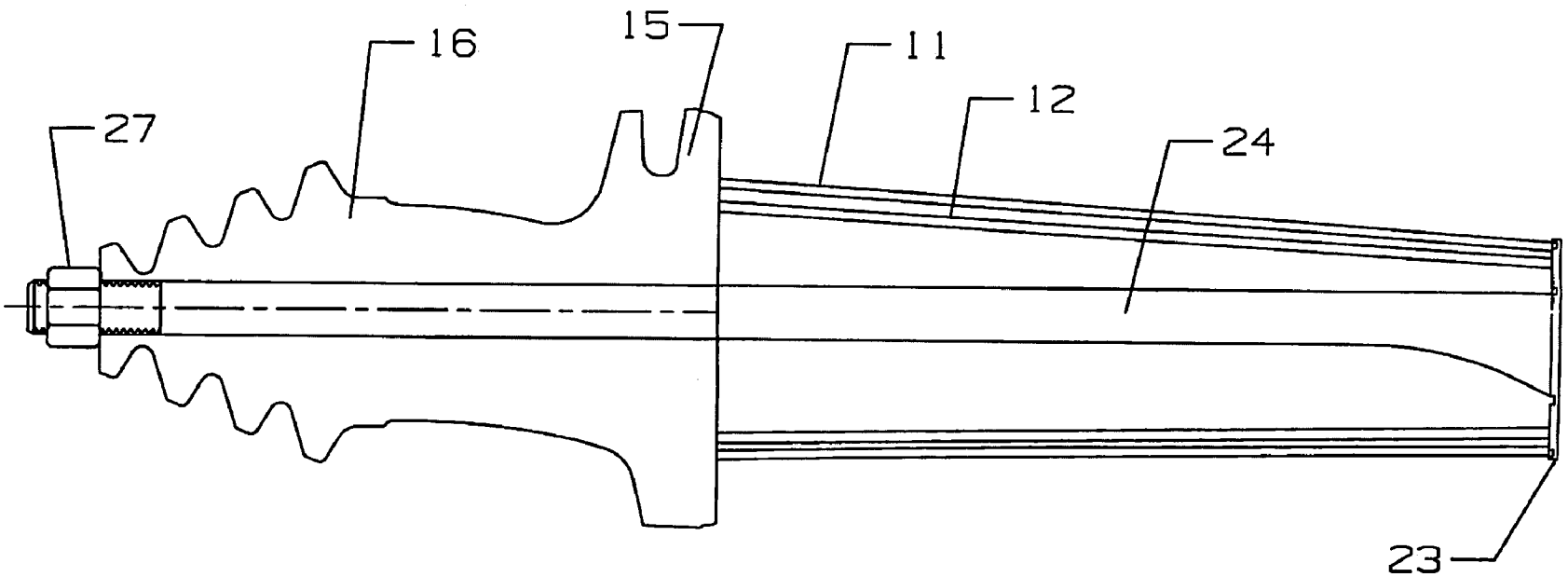
FIG. 3 shows a cross section view of the turbine blade of the second embodiment in an assembled state.

FIG. 3 shows a second embodiment of the present invention in which the spar and shell are the same but the tip cap is secured to the platform and root in a different way. The tip cap 23 includes a conical shaped transition 24 that also extends through the spar and through the root 16 so that a threaded nut 27 can be screwed onto the threaded end of the tip cap extension 24. The tip cap 23 and the conical extension and the extension that forms the bolt are all formed as a single piece in the FIG. 3 embodiment. The pieces in the FIG. 3 embodiment are made from the same materials as in the FIG. 1 embodiment. The bolt 27 in FIG. 3 can be made from the MP159 materials for strength.

In all the above embodiments, the single piece root and platform can be made from a prior art material such as nickel super alloys and from the investment casting process.

We claim:

1. A turbine blade for a gas turbine engine comprising:

a platform and root;

a thin wall shell having an airfoil cross sectional shape with a leading edge and a trailing edge, and a pressure side wall and a suction side wall extending between the two edges;

a spar having an airfoil cross sectional shape with a leading edge and a trailing edge, and a pressure side wall and a suction side wall extending between the two edges;

a tip cap to secure the shell to the spar;

the tip cap includes a conical shaped transition extending toward the platform and shaped to spread a stress load around sides of the tip cap; and, the conical shaped transition has an upper end that extends from a leading edge of the tip cap to a trailing edge of the tip cap within a space formed within the shell.

2. A turbine blade for a gas turbine engine comprising:

a platform and root;

a thin wall shell having an airfoil cross sectional shape with a leading edge and a trailing edge, and a pressure side wall and a suction side wall extending between the two edges;

a spar having an airfoil cross sectional shape with a leading edge and a trailing edge, and a pressure side wall and a suction side wall extending between the two edges;

a tip cap to secure the shell to the spar; and, the tip cap includes a conical shaped transition extending toward the platform and shaped to spread a stress load around sides of the tip cap;

the tip cap includes a threaded hole facing the platform; and, a bolt passing through the root and platform screws into the threaded hole to secure the spar and shell to the platform.

3. The turbine blade of claim 1, and further comprising:

the tip cap includes a bolt extension extending from the conical shaped transition;

the root and platform includes a hole passing through to receive the bolt extension; and, a threaded nut screwed onto the bolt extension to secure the spar and shell to the platform.

4. The turbine blade of claim 1, and further comprising:

the shell and the spar are formed by a wire EDM process.

5. The turbine blade of claim 1, and further comprising:

the shell is Molybdenum.

6. The turbine blade of claim 1, and further comprising:

the spar is made from Waspalloy or IN100.

7. The turbine blade of claim 1, and further comprising:

the tip cap and conical transition is a single piece and made from Molybdenum.

8. The turbine blade of claim 2, and further comprising:

the bolt is made from MP159.

9. The turbine blade of claim 1, and further comprising:

the shell is a thin wall shell made from Molybdenum.

10. The turbine blade of claim 1, and further comprising:

the tip cap and conical transition is a single crystal material.

11. The turbine blade of claim 1, and further comprising:

the tip cap and conical transition is a directional solidified material.

12. The turbine blade of claim 1, and further comprising:

a bolt or bolt extension passing through a leading edge region of the spar to secure the shell between the tip cap.

13. The turbine blade of claim 1, and further comprising:

the tip cap includes a threaded hole facing the platform; and, the threaded hole is closer to a leading edge side of the blade tip than a trailing edge side.

14. A tip cap for a turbine rotor blade having a spar and shell construction with the tip cap secured to the spar to secure the shell between the tip cap, the tip cap comprising:

a leading edge side and a trailing edge side;

a pressure side and a suction wall side both extending between the leading edge and the trailing edge;

an underside of the tip cap forming an abutment surface for a top end of the shell;

a conical shaped transition piece extending from a lower side of the tip cap;

a fastener hole opening on a bottom end of the conical shaped transition piece;

the fastener hole located closer to the leading edge than the trailing edge of the tip cap; and, the conical shaped transition has an upper end that extends from a leading edge of the tip cap to a trailing edge of the tip cap within a space formed within the shell.

15. The tip cap of claim 14, and further comprising:

the fastener hole opening is adjacent to a widest section of the tip cap.

16. A turbine blade for a gas turbine engine comprising:

a platform and root;

a thin wall shell having an airfoil cross sectional shape with a leading edge and a trailing edge, and a pressure side wall and a suction side wall extending between the two edges;

a spar having an airfoil cross sectional shape with a leading edge and a trailing edge, and a pressure side wall and a suction side wall extending between the two edges;

a tip cap separate from the spar;

a threaded bolt to secure the shell and the spar between the tip cap and the platform with the spar being located within the shell;

the tip cap includes a threaded hole facing the platform; and, a bolt passing through the root and platform screws into the threaded hole to secure the spar and shell to the platform.

17. The turbine blade of claim 16, and further comprising:

the tip cap includes a conical shaped transition extending toward the platform shaped to spread a stress load around sides of the tip cap.

* * * * *